US006629372B2

(12) United States Patent
Doyle

(10) Patent No.: US 6,629,372 B2
(45) Date of Patent: Oct. 7, 2003

(54) MODIFIED SQUARE

(76) Inventor: Martin Doyle, 824 Short St., McKees Rock, PA (US) 15136

( * ) Notice: Subject to any disclaimer, the term of this patent is extended or adjusted under 35 U.S.C. 154(b) by 0 days.

(21) Appl. No.: 09/792,326

(22) Filed: Feb. 23, 2001

(65) Prior Publication Data

US 2002/0116834 A1 Aug. 29, 2002

(51) Int. Cl.[7] ..... B43L 7/027
(52) U.S. Cl. ..... 33/429; 33/474
(58) Field of Search ..... 33/429, 474, 476, 33/480, 562, 563, 565, 566

(56) References Cited

U.S. PATENT DOCUMENTS

| | | | | | |
|---|---|---|---|---|---|
| 59,721 | A | * | 11/1866 | Kellogg | 33/429 |
| 387,966 | A | | 8/1888 | Beckwith | |
| 1,048,333 | A | | 12/1912 | Mishler | |
| 1,239,742 | A | | 9/1917 | Taylor | |
| 1,980,750 | A | * | 11/1934 | Dixon | 33/476 |
| 2,026,274 | A | * | 12/1935 | Doyle | 33/429 |
| 2,654,153 | A | | 10/1953 | Oyler | |
| 4,736,525 | A | | 4/1988 | Deason | |
| 5,253,426 | A | * | 10/1993 | Mosbrucker | 33/429 |
| D345,514 | S | | 3/1994 | Donnelly | |
| 6,317,993 | B1 | * | 11/2001 | Loyd | 33/412 |

* cited by examiner

*Primary Examiner*—Diego Gutierrez
*Assistant Examiner*—Amy R Cohen
(74) *Attorney, Agent, or Firm*—James Ray & Associates

(57) ABSTRACT

A squaring tool formed of a flat piece of rigid material having a primary "L" configuration, including a first horizontal blade and a first vertical tongue, said first horizontal blade and said first vertical tongue lying in a common plane and intersecting at a perfect 90° right angle. A secondary "L" shaped form is included having a second horizontal blade and a second vertical tongue, with the second horizontal blade and the second vertical tongue also lying in a common plane and also intersecting at a perfect 90° right angle. The second horizontal blade extends from an inside edge of the first vertical tongue such that all blades and tongues lie in a common plane and the second horizontal blade is parallel to and spaced below the first horizontal blade, and the second vertical tongue is parallel to and spaced from the first vertical tongue.

6 Claims, 3 Drawing Sheets

MODIFIED SQUARE

FIELD OF THE INVENTION

This invention relates generally to a squaring tool such as a carpenter's square as used by carpenters and other skilled tradesmen to mark and/or square-up adjacent workpieces. More particularly, this invention relates to a modified squaring tool having two inside corners and a total of three 90° degree square corners which are squared with each other, thus permitting the edges of the modified squaring tool to be positioned to extend around obstructions and irregular surfaces, thereby making the modified squaring tool particularly useful for a large number of applications and uses where a conventional carpenter's square cannot be used.

BACKGROUND OF THE INVENTION

A carpenter's square is a well known marking and squaring tool useful in many trades in addition to carpentry, and in its most common form merely comprises a generally "L" shaped flat piece of metal or other rigid material, with a pair of flat ruler-like extensions or legs lying in a common plane and intersecting at a perfect 90° right angle. Usually the legs or extensions are not of equal length and are normally marked to provide a length scale of some sort, such as inches or centimeters, while the flat faces of the legs are capable of lying flat on a work-piece surface so that one leg edge can be used for indicating and marking a straight line perpendicular to the intersecting leg or leg edge.

Accordingly, the two outer leg edges, as well as the two inner leg edges, of the square intersect to form perfect intersecting right angles. Thus when one leg edge of a carpenter's square is positioned flush against a workpiece surface, the other leg will always extend perpendicularly from such surface which can be used to mark and measure a perpendicular length from that surface.

In addition to the above general description, it is noted that in the carpenter's trade the leg normally used for horizontal positioning is often slightly wider and is commonly referred to as the "blade", while the leg extending from the "blade", normally being a bit narrower and bit shorter, is commonly referred to as the "tongue". Carpenter's squares are commercially available in three conventional sizes, namely, large, intermediate and small, wherein the blade lengths are 24, 16 and 12 inches respectively, and the tongue lengths are 16, 12 and 8 inches respectively.

While such conventional prior art carpenter's squares are extremely useful and have been successfully utilized by carpenters and other tradesmen for many years, there are some applications to which they do not readily lend themselves, particularly applications involving flange-like extensions adjacent a flat surface.

For example with regard to a common table comprising a flat horizontal upper surface or table top supported on legs or other vertically oriented supporting member or members, it is not possible to utilize a conventional carpenter's square to perpendicularly align the upper table top surface with the legs or other vertical support members. In such a situation, it is, of course, possible to utilize a conventional carpenter's square to perpendicularly align the supports or legs with the underside surface of the table top, but this in not particularly helpful if the underside surface is not parallel to the upper surface.

For example, such a situation does in fact present itself when working with steel I-beams where it is well known that the under-surfaces of the two I-beam flange are not parallel to the outer flat surfaces of those same flanges. That is to say, it is well known that the cross-section of an I-beam is that of a capital letter "I" where the flanges are perfectly flat, but the undersurface thereof are slightly angled towards the web which spaces the two flanges, and are further characterized by a smooth curved surface blending into the side surfaces of the web.

Indeed, other situations present themselves wherein a conventional carpenter's square fails to provide a suitable solution, such as squaring a horizontal surface with a vertical surface where obstructions are attached to one or the other of the intersecting surfaces.

SUMMARY OF THE INVENTION

This invention is predicated on my conception and development of a new and modified squaring tool which in essence comprises two squares-in-one which permits a first square to extend around a protruding or interfering flange or other obstruction, and provides three perfect 90° right angles squared with each other to greatly expand the applications for which the squaring tool can be used. In essence, the inventive modified squaring tool of this invention is formed of a flat piece of rigid material, such as steel, and comprises an outer primary L-shaped square formed by a pair of ruler-like legs lying in a common plane and intersecting at a perfect 90° right angle, substantially like a conventional carpenter's square. Pursuant to this invention, however, there is an inner or secondary L-shaped square extending from an inside edge of the primary L-shaped square which is also formed by a pair of ruler-like legs lying in a common plane and also intersecting at a perfect 90° right angle, substantially like the primary L-shaped square, with all four ruler-like legs lying in one common flat plane to in essence provide a pair of parallel horizontal legs and a pair of parallel vertical legs.

Stated in another way, the tool of this invention comprises a more or less conventional carpenter's square having a primary horizontal blade with a primary vertical tongue extending perpendicularly from one end of the horizontal blade as in the case of a conventional carpenter's square, but pursuant to this invention, the form also including a secondary square disposed intermediate the primary blade and primary tongue, wherein such secondary square includes a secondary blade extending from an inside edge of the primary vertical tongue, with a secondary tongue extending perpendicularly from the secondary blade at the distal end opposite the primary tongue, to thereby provide an overall configuration somewhat resembling that of a "question mark". In essence, the secondary tongue provides a tongue which is perpendicular to both the primary and secondary blades, but is spaced away from the primary blade by the distance separating the parallel primary and secondary blades. In use this spaced relationship can be utilized to align the unique modified squaring tool to extend around flanges or other obstruction to maintain the square relationship between the primary blade and the secondary tongue, so that even though the secondary tongue is spaced from the primary blade, it nevertheless remains perpendicular thereto.

OBJECTS OF THE INVENTION

Accordingly, it is a primary object of this invention to provide a new and modified squaring tool for use in a variety of applications where a conventional carpenter's square cannot be utilized.

Another primary object of this invention is to provide a new and modified squaring tool having a pair of horizontal blades and a pair of vertical tongues perpendicular to the horizontal blades, and adapted to extend around flanges and other obstructions to maintain the perpendicular relationship of the horizontal blades to the vertical tongues.

A further object of this invention is to provide a new and unique squaring tool which provides a space between two parallel blades which permit a tongue portion to extend around obstructions while that tongue portion remains perpendicular to the two parallel blades.

These and other objects and advantages of this invention will become apparent after a full reading of the following detailed description, particularly when read in conjunction with the attached drawings described below.

BRIEF DESCRIPTION OF THE DRAWINGS

FIG. 3*b* again illustrating the use of the squaring tool on a steel I-beam as may be used for marking distances on the I-beam web as measured from the upper flange top surface; and FIG. 3*c* illustrating use of the squaring tool for marking joist cut-outs on a roof support beam.

DESCRIPTION OF A PREFERRED EMBODIMENT OF THE INVENTION

Figure 1:
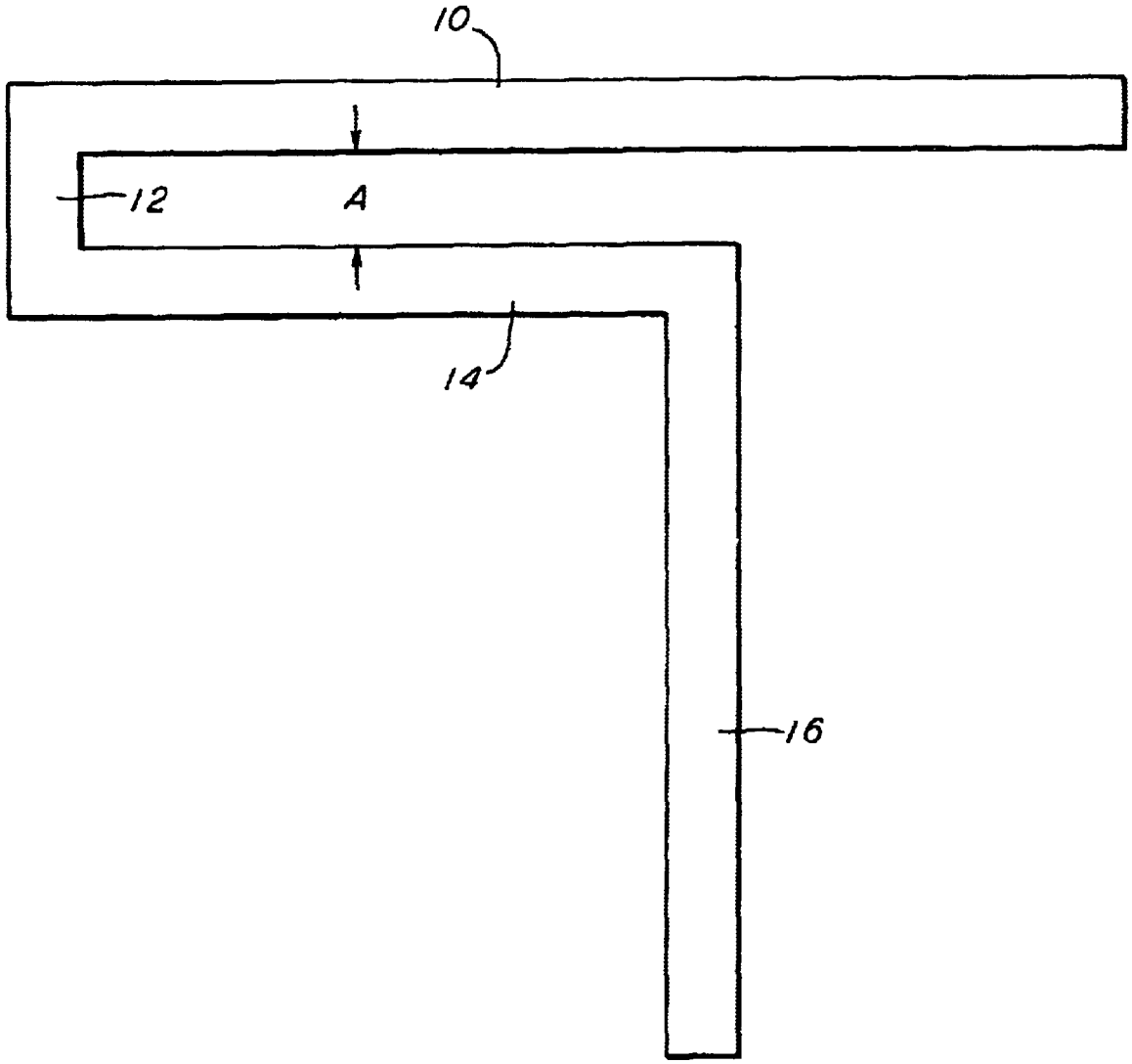
FIG. 1 is a plan view of a modified square squaring tool in accordance with a presently preferred embodiment of this invention without showing any specific dimensions.

Reference to FIG. 1 will illustrate a presently preferred embodiment of this invention, which as noted above, does not indicate any particular dimensional parameters, and comprises a flat L-shaped piece of rigid material, such as steel, having a pair of ruler-like extensions, legs or strips lying in a common plane and intersecting at a perfect 90° right angle to form an outer or primary two legged square having a horizontal blade, and a vertical tongue, substantially in accord with a conventional carpenter's square.

Unique to this invention, however, an inner or secondary square is formed by another pair of ruler-like extensions, legs or strips, also lying in a common plane and also intersecting at a perfect 90° right angle to also provide a horizontal blade and a vertical tongue.

The two squares; i.e., the primary and secondary squares are joined such the upper horizontal leg (blade) of the secondary square extends from an inside edge of the vertical leg (tongue) of the primary outer square, so that in essence two horizontal legs (blades) are provided which are parallel, one over the other, and two vertical legs (tongues) are provided which are parallel to each other but not side-by-side. Rather, the inside edges of the two vertical tongues are spaced by the length of the secondary blade.

With a more specific reference to FIG. 1, the primary square comprises the horizontal blade 10 joined at a perfect 90° right angle to the vertical tongue 12, while the secondary square comprises horizontal blade 14 extending perpendicularly from an inside edge of vertical tongue 12 and extends parallel to, and directly under horizontal blade 10, and includes vertical tongue 16 extending downwardly from the distal end of horizontal blade 14, which is spaced from and parallel to vertical tongue 12, so that again a perfect 90° right angle is formed between horizontal blade 14 and vertical tongue 16. As should be apparent, the two horizontal blades 10 and 14 will always remain parallel as will, of course, the two vertical tongues 12 and 16.

As can be seen by further reference to FIG. 1, there is a space "A" between the two parallel horizontal blades 10 and 14 separated by a distance which is not particularly critical but may be varied as desired for varying applications of the inventive squaring tool.

Figure 2:
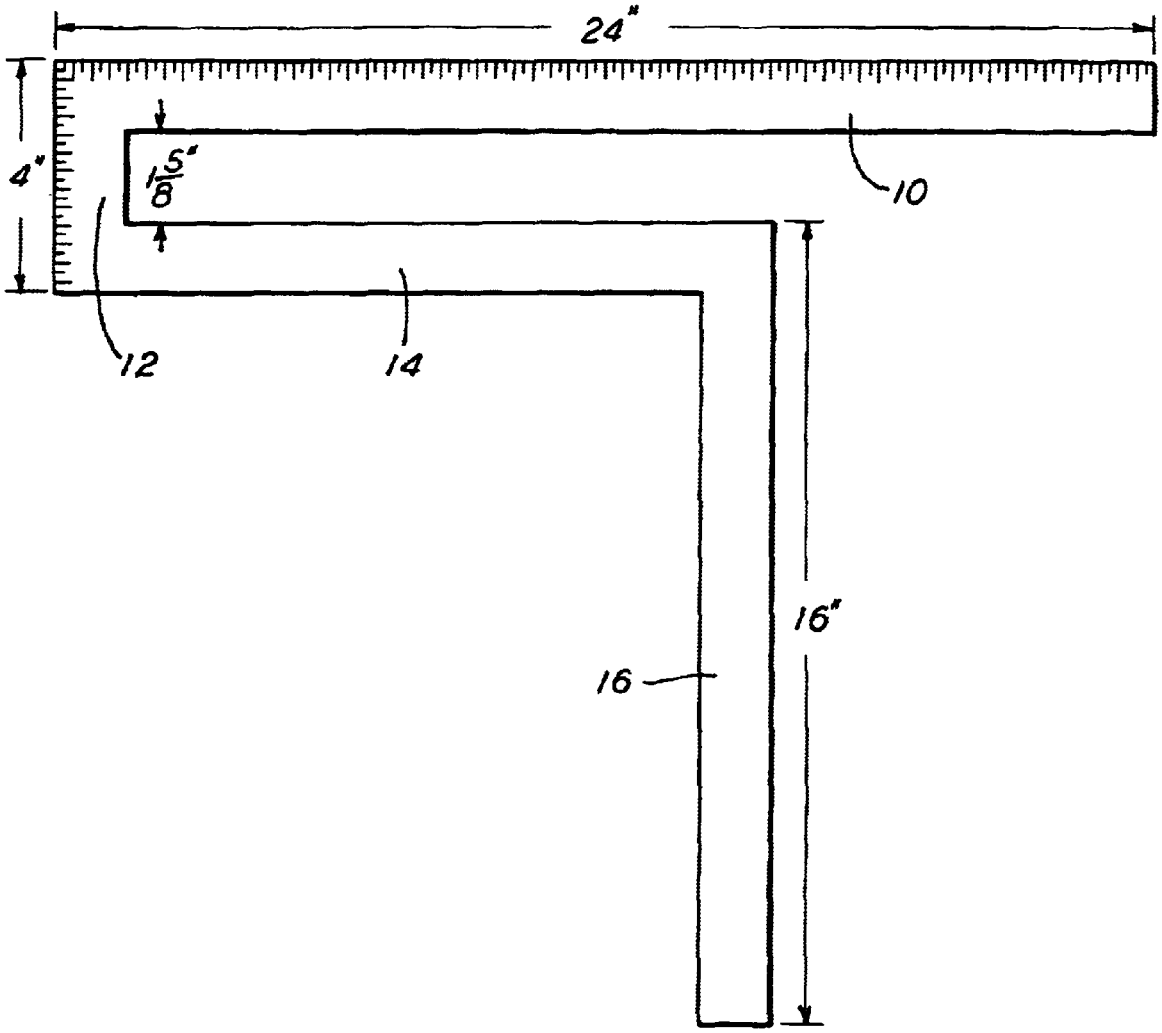
FIG. 2 is substantially the same as FIG. 1 except for the fact that specific preferred dimensions are shown for one preferred embodiment and further showing dimensional markings thereon for that particularly embodiment.

While reference to FIG. 2 will illustrate some specific dimensions for the modified squaring tool of this invention which have been found to be particularly helpful, it should be understood that this invention is not limited to a squaring tool having those dimensions, as those dimensions are merely suggested for applications involving conventional carpentry using conventional cut lumber such as 2×4's, 2×6's etc.

For this particular embodiment space "A" measures a gap of about 1⅝ inch which provides a perfect slot for use with 2×4's, 2×6's' 2×8's, 2×10's and 2×12's. In keeping with carpentry applications, the primary blade should preferably have a length of about 24 inches, as is common to a large conventional carpenter's square, with the secondary tongue having a length of about 16 inches. To accommodate space "A" with a gap of about 1⅝ inches the outside length of such primary tongue should be a bit more than about 4 inches, if the width of the secondary blade and secondary tongue are maintained at about 1.5 inches.

By providing the space "A", a notched-out portion of the primary square is provided so that the primary blade can be positioned horizontally against a workpiece such that the notched-out portion, i.e. space "A", can be made to extend around any flange, or other such obstruction, to provide a spaced-away elongated tongue that despite the fact that it is spaced-away, nevertheless remains perpendicular to both horizontal blades, and thus maintains its perpendicular relationship to the horizontal blades. Indeed, there are many applications where this relationship can be utilized to an advantage.

Figure 3A:
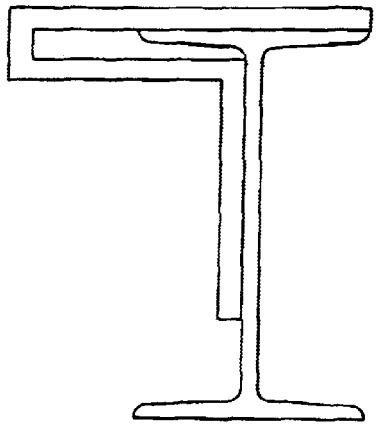
FIGS. 3*a*, 3*b* and 3*c* each illustrate a cross-sectional situation where the squaring tool of this invention can be beneficially utilized, with FIG. 3*a* illustrating use of the squaring tool on a steel I-beam to provide a tongue perpendicular to the upper flange top surface as may be used for marking perpendicular distances on a flange abutting the end of the I-beam.
Figure 3B:
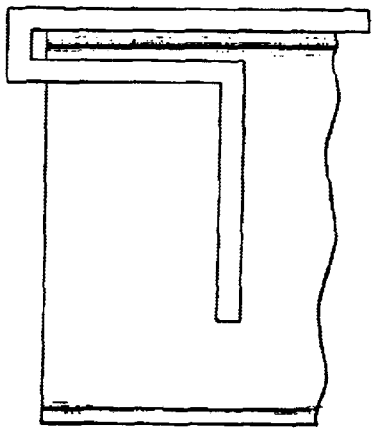
Figure 3C:
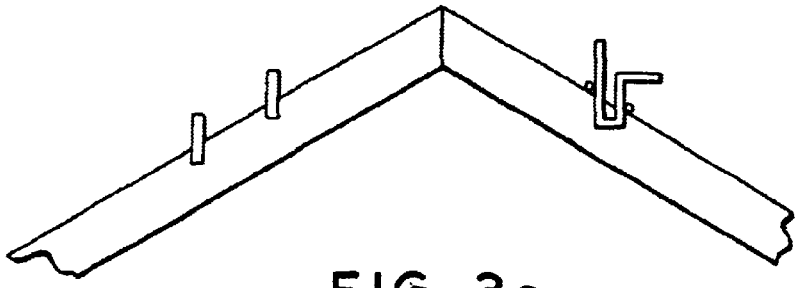

Reference to FIGS. 3*a*, 3*b* and 3*c* will illustrate some typical cross-sectional situations where the modified squaring tool of this invention has been found to be useful. In FIG. 3*a* use of the squaring tool on a steel I-beam is illustrated to provide a tongue perpendicular to the upper flange top edge of the beam as may be used for marking perpendicular distances on an adjacent work-piece (such as small lengths of angle iron) abutting the end of the I-beam. FIG. 3*b* again illustrates the use of the squaring tool on a steel I-beam as may be used for marking distances on the web as measured from the upper flange top surface. FIG. 3*c* illustrates the use of the squaring tool for marking joist cut-outs on a roof support beam.

In this particular embodiment, stair gages "b" are clamped onto the squaring tool to assist in repeatedly setting-up the squaring tool. Stair gages are well known in the carpentry art for providing a stop means on the side of a carpenter's square, and need not be described here.

Having described in detail one presently preferred embodiment of this invention, it should be apparent that other embodiments could be utilized and modifications incorporated without departing from the spirit of the invention. For example, the dimensions of the various blades and tongues can be varied to any extent that may be helpful for any particular application. The same is true for any dimensional marking that one may choose to place on the surfaces of the blades and tongues, such as inches or centimeters or any other marking as may be useful. Accordingly, it is apparent that there are numerous other modifications and embodiments that could be made to the above described squaring tool without departing from the spirit of the invention.

I claim:

1. A squaring tool formed of a flat piece of rigid material consisting of a primary "L" shaped configuration, having a first and a second elongated strip lying in a common plane and intersecting at a perfect 90° right angle, a secondary "L" shaped configuration having a third and a fourth elongated strip lying in a common plane and having an intersection at a perfect 90° right angle, said secondary "L" shaped configuration having said third elongated strip, attached at a first end thereof to and extending inwardly from one end of said first elongated strip of said primary "L" shaped configuration and, said fourth elongated strip of said secondary "L" shaped configuration attached at a first end thereof to a second end of said third elongated strip of said secondary "L" shaped configuration and a second end of said fourth elongated strip extending in a direction such that it is furthest away from said second elongated strip of said primary "L" shaped configuration, and said squaring tool having parallel top and bottom planar surfaces.

2. A squaring tool, according to claim 1, wherein at least some surfaces of said elongated strips are provided with uniformly spaced and parallel markings to indicate a length scale of said elongated strips.

3. A squaring tool, according to claim 1 wherein said elongated strip has a length of about 5 inches and said fourth elongated strip has a length of about 16 inches.

4. A squaring tool, according to claim 1 wherein confronting inner edges of said second elongated strip and said fourth elongated strip are substantially parallel.

5. A squaring tool, according to claim 1, wherein said second and third elongated strips are separated by a distance of about 1-⅝ inches.

6. A squaring tool, according to claim 5, wherein said second elongated strip has a length of about 24 inches and said first elongated strip has an outside length of about 4 inches.

* * * * *

UNITED STATES PATENT AND TRADEMARK OFFICE

CERTIFICATE OF CORRECTION

PATENT NO. : 6,629,372 B2
DATED : October 7, 2003
INVENTOR(S) : Martin Doyle

It is certified that error appears in the above-identified patent and that said Letters Patent is hereby corrected as shown below:

Column 6,
Line 11, after "said" please insert -- third --

Signed and Sealed this

Eleventh Day of May, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,629,372 B2
APPLICATION NO. : 09/792326
DATED : October 7, 2003
INVENTOR(S) : Martin Doyle It is certified that error appears in the above-identified patent and that said Letters Patent is hereby corrected as shown below:

Col. 6, Claim 4, line 16, please cancel “fourth” and insert --third--.

Signed and Sealed this

Nineteenth Day of December, 2006

JON W. DUDAS
*Director of the United States Patent and Trademark Office*